US006880511B1

(12) United States Patent
Coates

(10) Patent No.: US 6,880,511 B1
(45) Date of Patent: Apr. 19, 2005

(54) VALVE SEAL ASSEMBLY FOR ROTARY VALVE ENGINE

(76) Inventor: George J. Coates, Route 34 & Ridgewood Rd., Wall, NJ (US) 07719

( * ) Notice: Subject to any disclaimer, the term of this patent is extended or adjusted under 35 U.S.C. 154(b) by 0 days.

(21) Appl. No.: 10/693,155

(22) Filed: Oct. 27, 2003

(51) Int. Cl.[7] ..... F01L 7/00
(52) U.S. Cl. ..... 123/190.17
(58) Field of Search ..... 123/190.17, 190.14, 123/190.16, 190.1

(56) References Cited

U.S. PATENT DOCUMENTS 4,506,636 A * 3/1985 Negre et al. ..... 123/190.2
4,606,309 A * 8/1986 Fayard ..... 123/190.16
4,976,232 A * 12/1990 Coates ..... 123/190.17
4,989,558 A * 2/1991 Coates ..... 123/190.14
5,154,147 A * 10/1992 Muroki ..... 123/190.17
5,361,739 A * 11/1994 Coates ..... 123/190.14
5,509,386 A * 4/1996 Wallis et al. ..... 123/190.17
6,718,933 B1 * 4/2004 Coates ..... 123/190.17

* cited by examiner

*Primary Examiner*—Noah P. Kamen
*Assistant Examiner*—Jason Benton
(74) *Attorney, Agent, or Firm*—Clifford G. Frayne

(57) ABSTRACT

A valve seal for a rotary valve assembly for use in an internal combustion engine of the piston and cylinder type, wherein the cylinder head/combustion chamber is designed for high compression and of long stroke, such as a diesel engine, the rotary valves and the valve seals being positioned in relationship so as to permit charging of the cylinder with a fuel/air mixture and evacuation of spent gases, and to regulate the pressure within the valve seal and valve seat and hence regulate the pressure between the valve seal and the rotary valve.

5 Claims, 3 Drawing Sheets

VALVE SEAL ASSEMBLY FOR ROTARY VALVE ENGINE

BACKGROUND OF THE INVENTION

1. Field of the Invention

The present invention relates to an internal combustion engine of the piston-cylinder type having a spherical rotary valve assembly for the introduction of the fuel/air mixture to the cylinder and the evacuation of the exhaust gases, and is particularly directed to the floating valve seals for such rotary valve assembly and means for regulating pressure therein, particularly in long stroke, high compression engines such as diesels.

2. Description of the Prior Art

The Applicant herein has directed considerable attention to the internal combustion engine of the piston-cylinder type and in particular to the replacement of the poppet valve system, including the poppet valve, springs, mountings and associated cam shaft, with a spherical rotary valve assembly for the introduction of the fuel air mixture into the cylinder and for the evacuation of the exhaust gases. Applicant is the named inventor in U.S. Pat. No. 4,989,576, "Internal Combustion Engine"; U.S. Pat. No. 4,944,261, "Spherical Rotary Valve Assembly for Internal Combustion Engine"; U.S. Pat. No. 4,953,527, "Spherical Rotary Valve Assembly for Internal Combustion Engine"; U.S. Pat. No. 4,976,232, "Valve Seal for Rotary Valve Engine"; U.S. Pat. No. 4,989,558, "Spherical Rotary Valve Assembly for Internal Combustion Engine"; U.S. Pat. No. 5,109,814, "Spherical Rotary Valve"; U.S. Pat. No. 5,361,739, "Spherical Rotary Valve Assembly for Use in a Rotary Valve Internal Combustion Engine"; and U.S. Pat. No. 6,308,676 B1, "Cooling System for Rotary Valve Engine", and pending U.S. application Ser. No. 10/280,293. The aforementioned U.S. Patents are incorporated herein as if set forth in length and in detail.

The valve seal as described in Applicant's prior patents is a floating valve seal within a valve seat. The valve seal is positioned in the lower half of the split head assembly proximate the intake port and exhaust port for the cylinder. A biasing means is positioned within the valve seat and the valve seal is positioned above the biasing means. The upper surface of the valve seal is arcuate in shape conforming to the periphery of the rotary intake or rotary exhaust valve of the spherical rotary intake or spherical rotary exhaust valve assembly. The underbody of the valve seal sitting within the valve seat would have one or more sealing rings positioned thereabout in an annular sealing contact with the outer wall of the valve seat. In this configuration the valve seal floats within the valve seat and there is a slight gap between the inner wall of the valve seat and the valve seal which allows for the compressed gases to enter the valve seat through this gap and pressurize the area between the valve seal and the valve seat during the compression stroke which further provides for tight sealing contact between the valve seal and the spherical rotary intake and spherical rotary exhaust valves.

In short stroke engines, the assembly works without modification because of the relatively short stroke of the piston and the resultant pressures developed. However in long stroke engines, such as diesels, in which the compression is significantly greater than in a conventional internal combustion engine, and which compression actually results in the detonation of the fuel/air mixture under signficantly higher pressure, the valve seal of a rotary valve assembly for a diesel engine requires a modified structure in that the compression gases would cause excessive pressure on the floating valve seal and its contact with the spherical rotary intake valve or spherical rotary exhaust valve.

The present invention which is the subject to this application relates to the floating valve seal and means for regulating pressure therein.

OBJECTS OF THE INVENTION

An object of the present invention is to provide for a novel and improved valve seal for a rotary valve engine.

A further object of the present invention is to provide for a novel and improved valve seal for a rotary valve engine in which the ceramic insert of the valve seal is positioned in a locking angle for improved life span.

A still further object of the present invention is to provide for a novel and improved valve seal for a rotary valve engine in which a gas tight seal is maintained by the pressure developed in the cylinder and combustion chamber.

A still further object of the present invention is to provide for an improved and novel valve seal for a spherical rotary valve assembly which requires no external lubrication.

A still further object of the present invention is to provide for a novel and improved valve, valve seal and cylinder head/combustion chamber arrangement for a rotary valve engine.

A still further object of the present invention is to provide for a novel and improved floating valve seal arrangement for a rotary valve engine assembly which regulates the pressure within the valve seal.

SUMMARY OF THE INVENTION

A valve seal for a rotary valve assembly for use in an internal combustion engine of the piston and cylinder type, wherein the cylinder head/combustion chamber is designed for high compression and of long stroke, such as a diesel engine, the rotary valves and the valve seals being positioned in relationship so as to permit charging of the cylinder with a fuel/air mixture and evacuation of spent gases, and to regulate the pressure within the valve seal and valve seat and hence regulate the pressure between the valve seal and the rotary valve.

BRIEF DESCRIPTION OF THE DRAWINGS

These and other advantages and improvements will be evident, especially when taken in light of the following illustrations wherein.

DETAILED DESCRIPTION OF THE INVENTION

Figure 1:
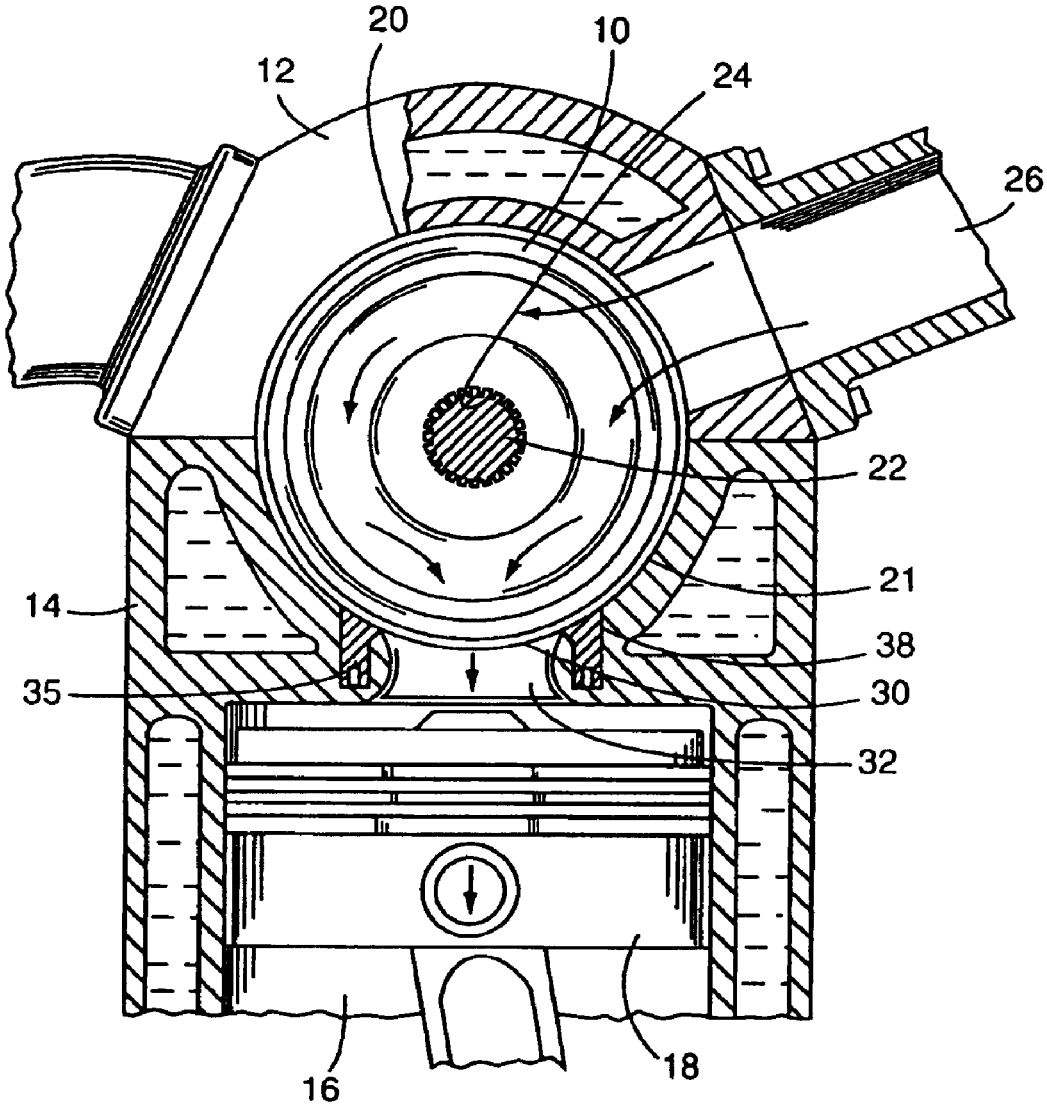
FIG. 1 is an end cross-sectional view of the head of the spherical rotary valve assembly showing the relationship of the spherical rotary valve to the cylinder, piston and valve seal.

Referring to FIG. 1, there is illustrated an end cross-sectional view of an embodiment of the spherical rotary valve assembly of Applicant's prior patents detailing the relationship between a rotary intake valve 10 enclosed within an upper half 12 and a lower half 14 of a split head assembly. The split head assembly is secured to an engine block having cylinder 16 within which piston 18 reciprocates.

The split head assembly comprising upper half 12 and lower half 14 defines a drum accommodating cavity 20 within which rotary intake valve 10 is positioned. Rotary intake valve 10 is positioned on shaft 22 which passes through a centrally positioned aperture 24 on the rotary intake valve 10. As discussed in detail in Applicant's prior patents heretofore set forth, rotary intake valve 10 provides for communication between fuel air inlet port 26 and cylinder 16 by means of an aperture 30 positioned on the spherical periphery 21 of the rotary valve 10 which comes into successive registration with inlet port 32 to cylinder 16.

Rotary intake valve 10 rotating within drum accommodating cavity 20 on shaft 22 is in contact with valve seal 35, annularly positioned in an annular groove or seat 38 about inlet port 321 to cylinder 16. Valve seal 35 serves to provide a seal to insure that the fuel/air mixture passes from rotary intake valve 10 into cylinder 16 during the intake stroke and further provides a seal with rotary intake valve 10 during the compression stroke to insure that the ignition of the fuel/air mixture occurs within cylinder 16 and does not migrate into drum accommodating cavity 20. Further, seal 35 provides a seal with rotary intake valve 10 during the exhaust stroke to insure that the exhaust gases exit through the rotary exhaust valve.

The description of valve seal as contained herein is made with respect to a rotary intake valve as shown and illustrated in FIG. 1. Valve seal is of the same design and serves the same purpose and function with respect to its relationship to the rotary exhaust valve of the spherical rotary valve assembly as disclosed in Applicant's prior patents heretofore identified. It is further understood that each cylinder would have at least one rotary intake valve and one rotary exhaust valve and a valve seal associated with each.

Figure 2:
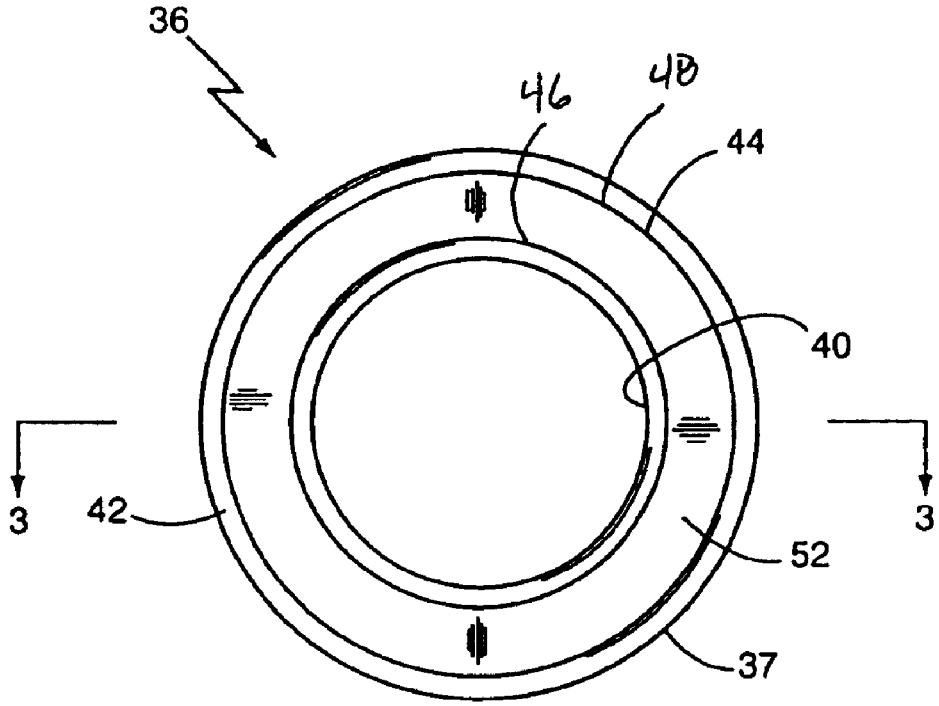
FIG. 2 is a top view of the improved valve seal of the present invention.
Figure 3:
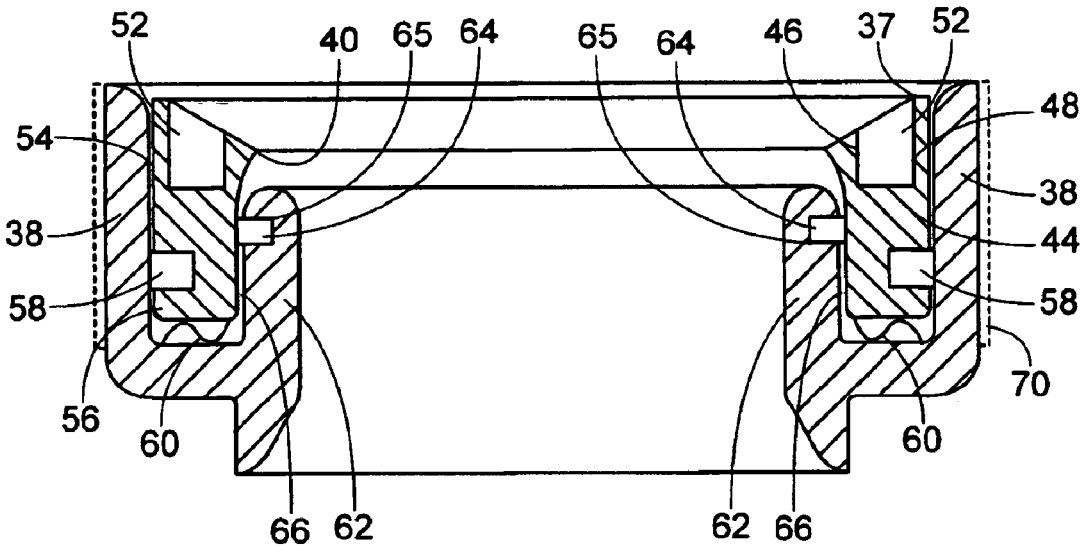
FIG. 3 is a side cutaway view of the improved valve seal and valve seat of the present invention along plane 3—3 of FIG. 2.

Referring now to FIGS. 2 and 3, which are a top view and cutaway view of an improved valve seal 36, there is illustrated a valve seal body 37 and a ceramic carbon insert lubricating ring 52 as more fully described hereafter. Valve seal 36 has a centrally disposed aperture 40 alignable with inlet port 32 when valve seal 36 is seated in annular groove or seat 38. The upper annular surface 42 of valve body 37 is curved inwardly towards the center of aperture 40. This curvature corresponding to the spherical periphery curvature 23 of the rotary intake valve 10. Upper surface 42 of valve body 37 is formed with an annular groove 44 which is defined by an inner side wall 46 and outer side wall 48. The inner side wall 46 forms a 90 degree angle, while outer side wall 48 forms an angle of less than 90 degrees. Annular groove 44 is for receipt of a ceramic carbon insert lubricating ring 52. The ceramic carbon insert lubricating ring 52 is positioned in the annular groove 44 such that its upper surface 54 corresponds with the curvature of the upper surface 42 of valve body 37. In mating the carbon insert lubricating ring to the valve body 37, valve body 37 would be heated so that it would undergo slight expansion. The ceramic carbon insert lubricating ring 52 would then be inserted into annular groove 44 during its heating process. The valve body 37 would then be allowed to cool. Since outer side wall 48 of the annular groove is slightly offset from 90 degrees in the direction of inner side wall 46, the ceramic carbon insert lubricating ring 52 is locked in position by this "locking angle" and is assured of remaining in position regardless of how hot the valve seal 36 became during the combustion process of the internal combusion engine. This is particularly important when the internal combustion engine to which the valve seal is affixed is being powered by natural gas or diesel which generate substantially higher temperatures and pressure than conventional gasoline fuel.

The outer side wall 54 of valve seal 36 is stepped and formed with a spaced apart annular rib 56 for the receipt and positioning of at least one sealing or blast ring 58 which function much like a piston ring establishing a seal between valve seal 36 side wall 54 and the periphery of annular groove or seat 38 about inlet port 32. In the present embodiment there is illustrated one rib 56 and one sealing or blast ring 58. However, if the depth of sidewall 54 were increased, the number of blast rings may be increased.

Contact between the valve body and the peripheral surface of rotary intake valve 10 is maintained by an annular beveled spring 60 positioned in the annular receiving groove of the valve seat. The pressure to be maintained upwardly on valve seal body is in the range of between 1 to 4 ounces as a result of the use of beveled spring 6.

Figure 4:
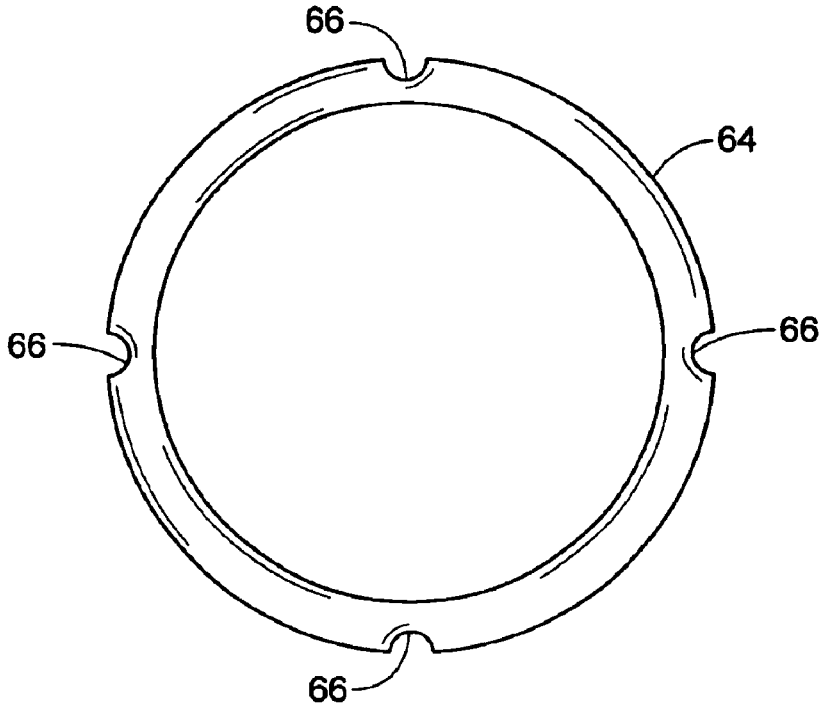
FIG. 4 is a top view of the pressure regulating ring of the improved valve seal of the present invention.

Additionally, the inner wall 62 of valve seat 38 has positioned therein a pressure regulating ring 64. In Applicant's prior embodiments, the increased gas pressure within the cylinder during the compression and power strokes was utilized to augment the sealing of the valve body with the peripheral surface of the rotary valve by means of annular passageway 66. It has been found that in short stroke engines the increase compression within the valve seat during the compression and power strokes did not have to be regulated. However, in long stroke and high compression engines, such as diesels, the amount of pressure within the valve seat which increases the contact of the valve body with the peripheral surface of the rotary valve must be regulated or the seal will generate a braking effect with respect to the rotation of the rotary valve. Therefore, pressure regulating ring 64 is positioned in an annular groove 65 on the inner wall of the valve seat 38 in the path of the compressed gases from the cylinder during the compression and power stroke. Pressure regulating ring 64 is in contact with the inner annular surface of the valve body 36 and pressure regulating ring 64 has a plurality of apertures 68 formed on its outer circumference which allows the compressed gases from the cylinder to pass through apertures 68 and into the valve seat 38 beneath the valve body 36 to allow for increased pressure on the valve body with the peripheral surface of the rotary valve. FIG. 4 is a top view of the pressure regulating ring of the present invention. The apertures 66 are in the form of semi circular apertures formed on the outer circumference or blast ring 64.

Heretofore, Applicant's "floating" valve seal body allowed the compressed gases during the compression and power stroke to bleed into the valve seat by means of an annular gap 66 between the inner circumferential wall of the valve body and the inner wall circumferential 66 of the valve seat 38. The pressure regulating ring 68 serves to limit the passage of the compressed gases via this route by blocking the route and only having a plurality of apertures 68 available for the introduction of the compressed gases into the valve seat 38 beneath the valve body 36. The number of apertures 68 can be varied depending upon the stroke and compression of the engine as measured by suitable measuring techniques.

The valve seal and the valve seat of prior prototypes of the Applicant/Inventor called for the valve seat to be friction fit within an annular groove within the lower head of the split head assembly. The valve and valve seat of the present invention may also be friction mounted in such an annular groove. However, since the valve and valve seat of the present invention are directed to high compression long stroke engines of significantly higher compression than a normal internal combustion engine found in an automobile, the valve seat could be externally threaded on its external circumference 70 so as to be threadedly secured to the annular groove in the lower head of the split head assembly which would similarly be threaded for receipt of the valve seat.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A valve seal for a rotary valve assembly for use in internal combustion engines of the piston and cylinder type having high compression and long stroke, the rotary valve assembly positioned within a two piece cylinder head, said cylinder head defining a plurality of drum accommodating cavities for receipt of a plurality of rotary intake valves and rotary exhaust valves, said rotary intake valves and said rotary exhaust valves having a spherical section defined by two parallel planes of the sphere, said planes being disposed symmetrically about the center of said sphere, defining a spherical periphery and planar end walls, said rotary intake valves and said rotary exhaust valves mounted on the shaft means within said drum accommodating cavities in gas tight sealing contact with an inlet port and an exhaust port respectively, said rotary intake valve and said rotary exhaust valves having passageways therethrough for the introduction and interruption of fuel air mixture to the engine and the evacuation of exhaust gases from the engine respectively, said gas tight sealing contact of said rotary intake valve and said rotary exhaust valve of said intake port and said exhaust port, respectively, accomplished by a valve seal and a valve seat, the valve seal and valve seat comprising:

a valve body member, substantially circular in cross section, said valve body member having a curved annular upper surface conforming to said spherical periphery of said intake valve or said exhaust valve, said valve body member having an aperture therethrough defined by an inner circular side wall coincidental with said aperture of said inlet port or said outlet port, said valve body member having an annular receiving groove formed on said curved upper surface about said aperture for receipt of a lubricating insert ring, said lubricating insert ring having a curved upper surface complimentary to said curved upper surface of said valve body member;

said valve body member further having an outer circumferential side wall having formed thereon a plurality of mounting ribs for the positioning about said outer circumferential side wall of said valve body member of a plurality of sealing rings for sealing contact of said valve body member to an outer wall of said valve seat;

said valve seat having an outer wall and an inner wall defining an annular groove for receipt of said valve body, said inner wall of said valve seat having an annular groove formed on an interior surface thereof for receipt of a pressure regulating ring, said pressure regulating ring contacting said valve body, said pressure regulating ring having a plurality of passageways therethrough for the passage of compressed gases during a compression stroke and power stroke of said engine so as to exert upward sealing pressure on said valve body.

2. A valve seal for a rotary valve assembly in accordance with claim 1 wherein said pressure regulating ring passageways are semi-circular in shape and formed on an outer periphery of said pressure regulating ring.

3. The valve seal for a rotary valve assembly in accordance with claim 1 wherein the number of said passageways in said pressure regulating ring determine the desired upward pressure exerted on said valve body.

4. The valve seal for a rotary valve assembly in accordance with claim 1 wherein said valve seat is frictionally positioned in a groove in said two piece cylinder head.

5. The valve seal for a rotary valve assembly in accordance with claim 1 wherein said valve seat is threadedly secured in an annular groove within said two piece cylinder head.

* * * * *